US006923464B2

(12) United States Patent
Noviant

(10) Patent No.: US 6,923,464 B2
(45) Date of Patent: Aug. 2, 2005

(54) PLATFORM FOR RAISING THE BINDERS FOR A BOOT, AND BOARD FOR GLIDING OVER SNOW EQUIPPED WITH SUCH A PLATFORM

(75) Inventor: Jérôme Noviant, Grenoble (FR)

(73) Assignee: Skis Rossignol SA, Voiron (FR)

( * ) Notice: Subject to any disclaimer, the term of this patent is extended or adjusted under 35 U.S.C. 154(b) by 0 days.

(21) Appl. No.: 10/195,322

(22) Filed: Jul. 16, 2002

(65) Prior Publication Data

US 2003/0025299 A1 Feb. 6, 2003

(30) Foreign Application Priority Data

Jul. 16, 2001 (FR) ..... 01 09462
Oct. 25, 2001 (FR) ..... 01 13779

(51) Int. Cl.[7] ..... A63C 5/00
(52) U.S. Cl. ..... 280/607; 280/617
(58) Field of Search ..... 280/607, 617, 280/608, 610, 611, 601, 616, 618, 602, 636, 623, 624, 633, 635, 609

(56) References Cited

U.S. PATENT DOCUMENTS 4,022,491 A * 5/1977 Powell ..... 280/618
4,067,593 A * 1/1978 Earl ..... 280/617
5,413,371 A * 5/1995 Trimble ..... 280/602
5,671,940 A * 9/1997 Abondance ..... 280/602
5,758,894 A * 6/1998 Maggiolo ..... 280/602
5,785,342 A * 7/1998 Bronson ..... 280/602
5,915,719 A 6/1999 Bauvois
6,193,262 B1 * 2/2001 Silva ..... 280/607
6,217,055 B1 * 4/2001 Silva ..... 280/607
6,227,558 B1 * 5/2001 Arduin et al. ..... 280/611
6,257,612 B1 * 7/2001 Zanco et al. ..... 280/607
6,619,688 B2 * 9/2003 Billon et al. ..... 280/607
2002/0113411 A1 * 8/2002 Deborde et al. ..... 280/607
2003/0025299 A1 * 2/2003 Noviant ..... 280/607
2003/0085550 A1 * 5/2003 Godde et al. ..... 280/617
2003/0155744 A1 * 8/2003 Gorza et al. ..... 280/618

FOREIGN PATENT DOCUMENTS

EP 1023926 2/2000
FR 2689722 A1 * 10/1992 ..... A63C/5/00
FR 2774001 7/1999
FR 2791269 9/2000

OTHER PUBLICATIONS

English Abstract for European Patent No. EP 1023926, Fastening device for skibindings, Leo Zirn, Aug. 8, 2002.

* cited by examiner

*Primary Examiner*—J. Allen Shriver
(74) *Attorney, Agent, or Firm*—Browdy and Neimark, P.L.L.C.

(57) ABSTRACT

A raising platform is intended for mounting on the upper surface (3) of a board (1) for gliding over snow in order to receive and to raise the bindings securing a user's boot to a board (1) for gliding over snow.

The raising platform is divided into two longitudinal parts (9, 11).

23 Claims, 5 Drawing Sheets

PLATFORM FOR RAISING THE BINDERS FOR A BOOT, AND BOARD FOR GLIDING OVER SNOW EQUIPPED WITH SUCH A PLATFORM

The present invention relates to a platform for raising the bindings for a boot of a user of a board for gliding over snow.

The present invention also relates to a board for gliding over snow, such as a ski, a monoski or a snowboard, equipped with a platform for raising the bindings for a boot.

A platform for raising the bindings is attached in the underfoot zone of a board for gliding, in the region of its upper surface. The platform is fixed to the board either directly by means of screws, in order to obtain a rigid link, or by virtue of elastic return means in the form, for example, of a layer of material having damping properties.

STATE OF THE ART

A platform is known from document EP-1,023,926, which has the form of two central support elements on which two distinct longitudinal uprights are placed in an overhanging fashion. Two rigid plates connecting the two mounting zones in pairs are screwed to each of the two ends of the two longitudinal uprights.

A platform is also known from documents FR-2,774,001 and U.S. Pat. No. 6,217,055, having the form of four distinct longitudinal mounting zones. A first transverse plate is screwed to the two front mounting zones and a second transverse plate is screwed to the two rear mounting zones.

The main drawback of these platforms is the absence of flexibility which may exist between the mounting zones which are fully coupled mechanically both by the central support elements and/or by the two rigid end plates.

SUMMARY OF THE INVENTION

The object of the invention is to propose a board for gliding over snow with a platform which is lighter by virtue of a choice of shape and which, moreover, makes it possible to separate the left and right bearing forces so as to transmit the forces applied by the user onto the board and the forces generated more directly in the region of the left edge or the right edge.

The platform according to the invention also makes it possible to give the board for gliding a novel, very slender aesthetic appearance, which can allow the protective and decorative layer of the board for gliding to remain visible.

A raising platform is intended for fitting on the upper surface of a board for gliding over snow in order to receive and to raise the bindings securing a user's boot to the board for gliding over snow.

According to the invention, the raising platform is characterized in that it is divided into two longitudinal parts.

Preferably, and in a second embodiment, at least one of the two longitudinal parts may comprise at least one recess. This or these recesses will be located in the region of its face of contact with the upper surface of the board for gliding over snow. This or these recesses may be filled with one or more materials which have properties of elasticity and damping.

In certain cases, when the two longitudinal parts are separated from one another, a spacing may be provided between the two longitudinal parts. This spacing may be left free. This spacing may also be filled by a convex zone of the board for gliding over snow which projects relative to the upper surface of the upper protective and decorative layer of the board for gliding over snow. This spacing may also be filled with a material which has properties of elasticity.

In a third embodiment, at least one of the two longitudinal parts of the platform may itself be divided transversely into at least two transverse pieces. When the transverse pieces are separated from one another, the space or spaces located between at least one of the transverse pieces may be filled with one or more materials having properties of elasticity.

The two longitudinal parts may, advantageously, and in a fourth embodiment, be secured to a board for gliding over snow which may have a thickness in the region of the front portion of the zone for fitting the platform greater than the thickness in the region of the rear portion of the zone for fitting the platform.

To secure it to the board for gliding over snow, at least one of the two longitudinal parts of the platform may favourably comprise two different anchoring zones. At least a first anchoring zone may allow a fixed positioning relative to the board for gliding over snow. At least a second anchoring zone, which is different from the first zone, may allow a positioning with sliding relative to the board for gliding over snow.

Preferably, at least one of the two longitudinal parts of the platform may have a tubular structure. This tubular structure may be provided over a part of or over all its length and over a part of or over all its width.

In another embodiment, at least one of the two longitudinal parts may extend laterally via at least one lateral portion. The lateral portion or portions may descend over each of the two lateral sides towards the edges of the board for gliding over snow. Additionally, the two lateral portions may, optionally, bear on the board for gliding over snow over the lateral sides. In a variant of this embodiment, the lower edge of the lateral portion or portions of at least one of the two longitudinal parts may, in a longitudinal plane, have a non-zero angle of inclination relative to the gliding sole of the board for gliding over snow.

Several possibilities are offered, with it being possible for at least one of the two longitudinal parts to extend laterally via a lateral portion positioned in the region of the zone for installation of the front stop of the binding for the boot on the ski or, alternatively, with it being possible for at least one of the two longitudinal parts to extend laterally via a lateral portion positioned in the region of the zone for installation of the rear heelpiece of the binding for the boot on the ski. At least one of the two longitudinal parts may extend very preferably laterally via a lateral portion positioned in the region of the zone for installation of the front stop of the binding for the boot on the ski and via a lateral portion positioned in the region of the zone for installation of the rear heelpiece of the binding for the boot on the ski.

The platform may have an asymmetry between the two longitudinal parts. The platform may have an asymmetry of length between the two longitudinal parts. The platform may have an asymmetry of width between the two longitudinal parts. The platform may have an asymmetry of the means for fitting between the two longitudinal parts. The platform may have an asymmetry in the number of transverse pieces between the two longitudinal parts. The platform may have an asymmetry of structure and of materials between the two longitudinal parts.

In the case of a competition ski, the purpose of the asymmetries mentioned above is to improve the behaviour of the two skis when turning, the racer bearing on both his skis. In the case of a recreational ski, the aim of the asymmetries mentioned above is to offer two types of behaviour, depending on whether the skier places his pair of skis left/right or, conversely, right/left. This enables the average skier to have the advantage of two pairs of skis in one, i.e. a ski more specifically dedicated to wide-radius turns and a ski more specifically dedicated to short-radius turns.

According to a second aspect of the invention, a board for gliding over snow is equipped with a platform as described above.

The board for gliding may have, on at least one of the two sides, a lateral notch located over the sides. This notch may allow a positioning of the two respective lateral portions of at least one of the two longitudinal parts of the platform. More preferably, the board may have, on at least one of the two sides, two lateral notches located over the sides. These two notches may allow a positioning of the two respective lateral portions of at least one of the two longitudinal parts of the platform.

Interestingly, the upper surface of the board for gliding may be substantially flush with the rigid upper face of at least one of the two longitudinal parts of the platform. The upper surface of the board for gliding over snow may comprise one or two ribs separated by a central hollow, the one or two ribs being in the extension towards the front and/or towards the rear of the one or two longitudinal parts of the platform.

The board for gliding may advantageously comprise a height discontinuity between the front portion of the zone for fitting the platform and the rear portion of the zone for fitting the platform. In this way, the thickness of the board for gliding over snow in the front portion of the zone for fitting the platform will be greater than the thickness of the board for gliding over snow in the rear portion of the zone for fitting the platform.

DESCRIPTION OF THE DRAWINGS

The invention will be properly understood and its various advantages and different characteristics will become more apparent during the following description of the non-limiting illustrative embodiment, with reference to the appended diagrammatic drawings in which.

DETAILED DESCRIPTION

Figure 1:
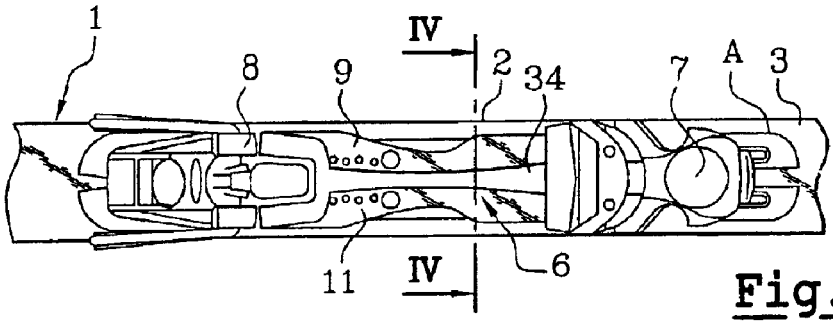
FIG. 1 shows a top view of the platform according to a first embodiment, with bindings positioned on a ski in partial view.
Figure 2:
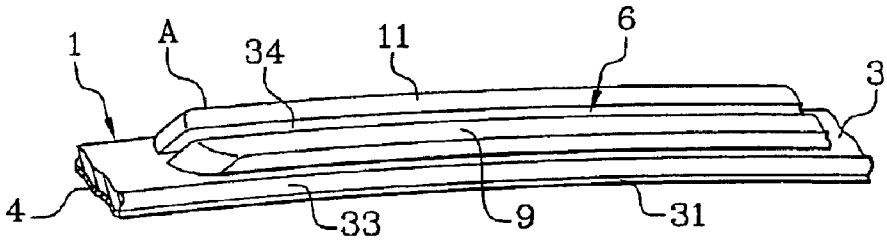
FIG. 2 shows a front lateral perspective view of the platform in FIG. 1, without the bindings.

A board for gliding over snow, of conventional type (cf. FIGS. 1, 2, 4A and 4B), such as an alpine ski (1), comprises a front zone including a tip, a middle zone called the underfoot zone (2), a rear zone, an upper surface (3) formed by a protective and decorative upper layer (3*a*), and a gliding sole (4). In the region of the underfoot zone (2) there is a platform (6) for raising the elements of the binding. Contrary to the state of the art, this platform has no need for supports or holding pieces.

The elements of the binding, i.e. the front stop (7) and the heelpiece (8), are screwed onto the raising platform (6). In all the figures, the reference sign (A) denotes the front part of the platform (6) oriented towards the tip, i.e. the part or zone towards which the front stop (7) of the binding for the boot on the ski (1) is more particularly installed.

According to the invention and in a first embodiment (cf. FIGS. 1, 2, 4A, 4B and 6), the platform (6) is divided into two along the central longitudinal axis of the ski (1) and therefore comprises two rigid longitudinal parts (9 and 11). The possibility of having two distinct longitudinal parts (9 and 11) will mean that the bearing forces exerted by the skier on one or other of the two longitudinal parts (9 or 11) will be transmitted directly to the edge (31) associated with it, and located just below, when, during a turn, the skier tilts his ski onto this edge (31).

Figure 3:
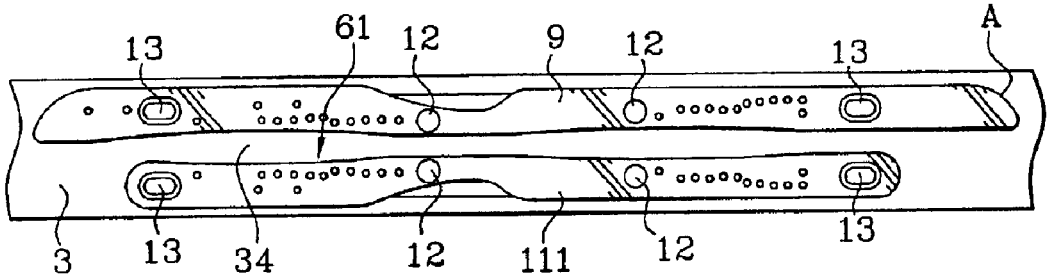
FIG. 3 shows a top view of the platform according to a second embodiment, mounted on a ski in partial view.

In a second embodiment (cf. FIG. 3), the platform (61) comprises two distinct rigid longitudinal parts (9 and 111). However, this platform (61) has an asymmetry of shape between the two longitudinal parts (9 and 111). The first longitudinal part (9) has a length corresponding to the length of the two longitudinal parts (9 and 11) of the first embodiment. The second longitudinal part (111) has a length which is shorter than that of the first longitudinal part (9). The first longitudinal part (9), the longer part, is preferably on the side of the inner edge (31) of the ski (1). The second longitudinal part (111), the shorter part, is preferably fitted on the side of the outer edge (31) of the ski (1). The two skis, the inner ski and the outer ski relative to the turn, bend differently and thus produce different turn radii.

Figures 4A, 4B:
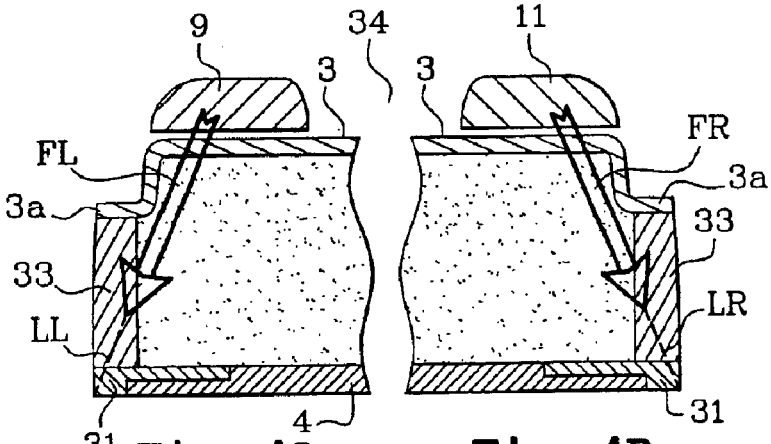
FIGS. 4A and 4B, respectively, show a left view and a right view in transverse section in the plane IV—IV in FIG. 1 of the ski with its platform.
Figure 5:
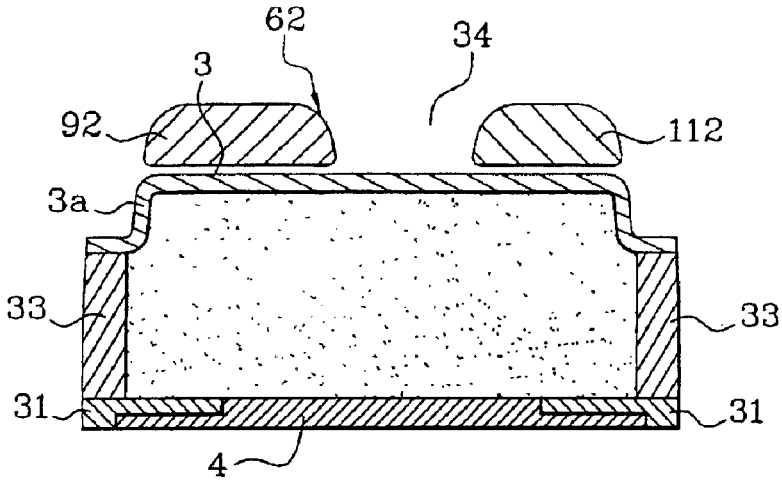
FIG. 5 shows a transverse-sectional view of a ski with its platform according to a third embodiment.

The transmission of the forces is more particularly represented in FIG. 4A, in which the skier, weighting the left edge (31), generates the force (FL), with its force transmission line (LL) (in dashes) starting from the first longitudinal part (9) and continuing to the left edge (31). In FIG. 4B, the skier, weighting the right edge (31), generates the force (FR), with its force transmission line (LR) (in dashes)

starting from the second longitudinal part (11) and continuing to the right edge (31).

Thus, the mechanical separation of the two longitudinal parts (9 and 11) which are thus functionally disconnected, the bearing forces and the forces generated on one (9) of the longitudinal parts will not be transmitted substantially to the other (11) of the longitudinal parts.

In FIGS. 1, 2, 3, 4A, 4B, 5, 6, 7, 9, 10, 11, 13 and 19, the two longitudinal parts (9 and 11) are clearly separated from one another, with a distance between them. This chosen separation means that the platform gains in lightness, owing to the absence of material and the lack of weight in the centre of the platform.

In a third embodiment (cf. FIG. 5), the platform (62) comprises two distinct rigid longitudinal parts (92 and 112). However, this platform (62) has an asymmetry of shape between the two longitudinal parts (92 and 112). The first longitudinal part (92) has a width greater than that of the two longitudinal parts (9 and 11) of the first embodiment. The second longitudinal part (112) has a width which is less than that of the two longitudinal parts (9 and 11) of the first embodiment. The second longitudinal part (112) is preferably fitted on the side of the outer edge (31) of the ski (1). This makes it possible to obtain an inside ski during the turn which is different from the outside ski during the turn and thus to have different turn radii.

In order to ensure they are held on the ski (1), each of these two longitudinal parts is secured directly onto the upper surface (3) of the ski (1). Screws or other securing means pass via through-holes made through each of the two longitudinal parts (9 and 11). The screws are perpendicular to the plane consisting of the upper surface (3) of the ski (1).

Figure 6:
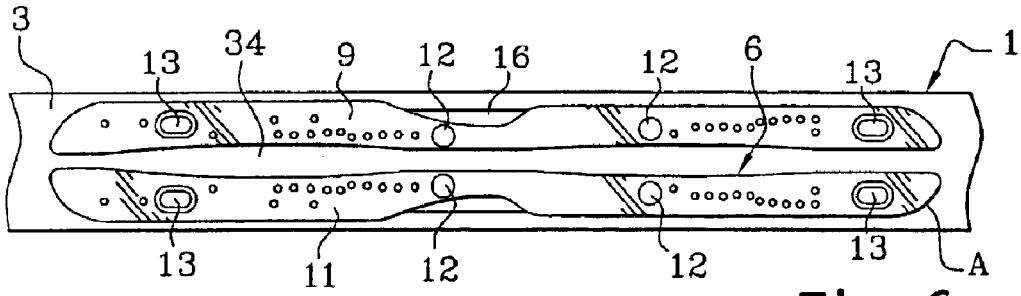
FIG. 6 shows a top view of the platform according to the first embodiment, mounted on a ski in partial view.
Figure 7:
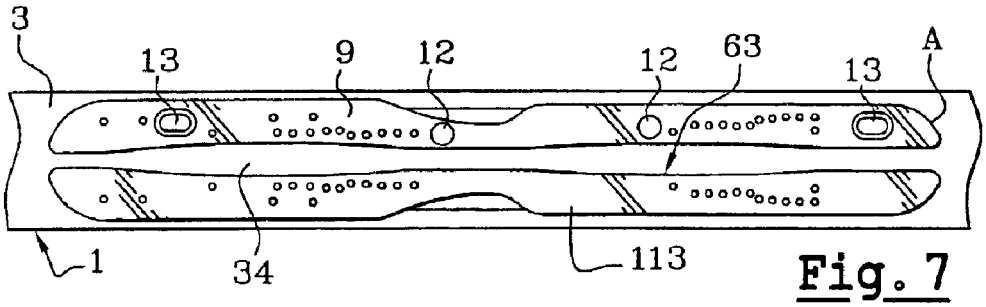
FIG. 7 shows a top view of the platform according to a fourth embodiment, mounted on a ski in partial view.

Each of the two longitudinal parts (9 and 11) comprises four different anchoring zones (cf. FIG. 6). Two first anchoring zones or securing means allow a fixed positioning relative to the ski. These first two anchoring zones consist of round holes (12). With these round holes (12), which are sized and which have a diameter which is substantially equal to the diameter of the fixing screw, no movement of the two longitudinal parts (9 and 11) relative to the rest of the ski (1) is possible. Two round holes (12) have thus been provided towards the centre of each of the two longitudinal parts (9 and 11).

Two second anchoring zones or securing means allow a positioning with sliding relative to the ski (1). These two second anchoring zones consist of elongate holes (13). With these elongate holes (13), having a width which is substantially equal to the diameter of the fixing screw and sized in terms of length so that they can allow an offset of the two longitudinal parts (9 and 11), only a sliding in the longitudinal direction of the two longitudinal parts (9 and 11) relative to the rest of the ski is possible. Two elongate holes (13) have thus been provided towards the two, front and rear, ends of each of the two longitudinal parts (9 and 11).

Towards the centre of each of the two longitudinal parts (9 and 11), the two fixed anchoring zones (12) add stiffness to the inherent stiffness of the ski (1). In the region of the two ends of each of the two longitudinal parts (9 and 11), with the two sliding anchoring zones (13), the ski (1) is thus free to deform without undergoing platform stresses. The same platform thus makes it possible to obtain different behaviours by means of a simple adjustment carried out by the end-user.

In a fourth embodiment (cf. FIG. 7), the platform (63) comprises two distinct rigid longitudinal parts (9 and 113). However, this platform (63) has an asymmetry of anchoring or, alternatively, an asymmetry of the fixing means between the two longitudinal parts (9 and 113). The first longitudinal part (9) has the two anchoring zones (12 and 13) corresponding to the two anchoring zones (12 and 13) described above. The second longitudinal part (113) has no anchoring zones, or has anchoring zones that are not used. This second longitudinal part (113) is adhesively bonded to the ski (1). Provision may also be made for two different types of adhesive bonding for each of the longitudinal parts. In this way, the contacts and deformations of the ski differ between the inside ski during turning and the outside ski during turning, the two-part platform separating the right bearing forces and the left bearing forces.

Figure 8:
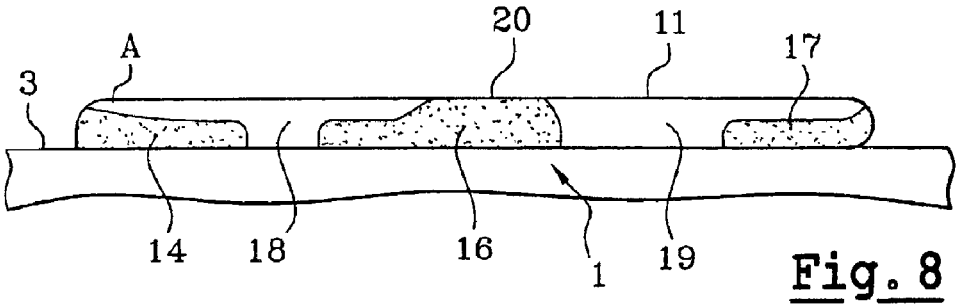
FIG. 8 shows a lateral view of the platform according to a fifth embodiment, mounted on a ski in partial view.
Figure 9:
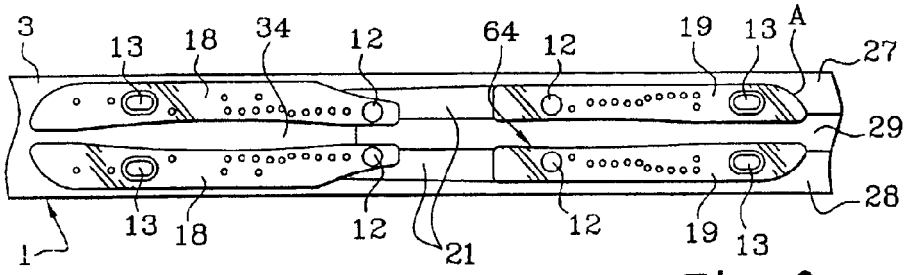
FIG. 9 shows a top view of the platform according to a sixth embodiment, mounted on a ski in partial view.
Figure 10:
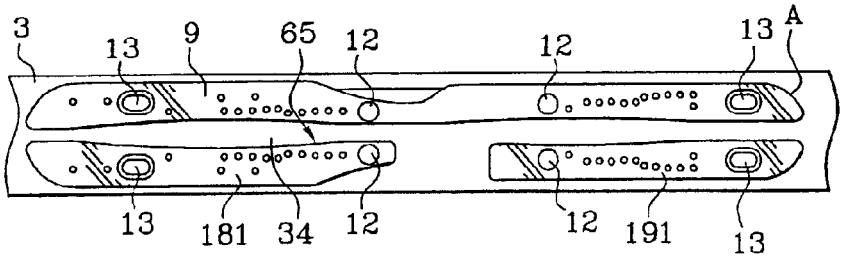
FIG. 10 shows a top view of the platform according to a seventh embodiment, mounted on a ski in partial view.
Figure 11:
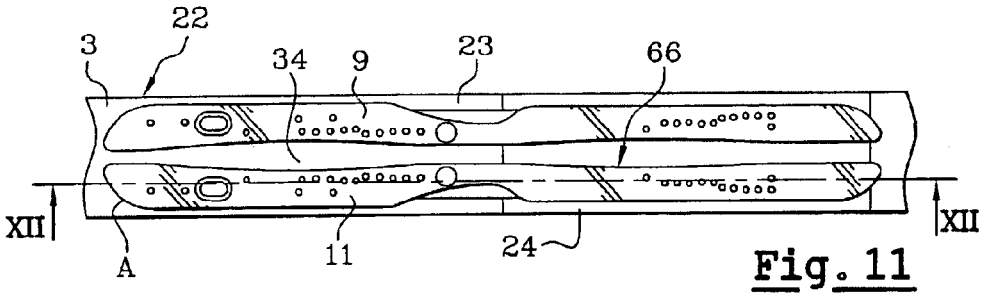
FIG. 11 shows a top view of the platform according to an eighth embodiment, mounted on a ski in partial view.

In a fifth embodiment (cf. FIG. 8), each of the two longitudinal parts (9 and 11) comprises three recesses (14, 16 and 17) located in the region of its face of contact with the upper surface (3) of the ski (1). Between the recesses (14, 16 and 17), the two longitudinal parts (9 and 11) comprise rigid sectors connected to the rigid upper face (20) of each of the two longitudinal parts (9 and 11).

The recess (14) is located at the front of the two longitudinal parts (9 and 11) of the platform. The recess (16) is located in the centre of the two longitudinal parts (9 and 11) of the platform. The recess (17) is located to the rear of the two longitudinal parts (9 and 11) of the platform. The shape of the central recess (16) is also arranged so as substantially to notch the rigid upper face (20) of the two longitudinal parts (9 and 11).

The recesses (14, 16 and 17) may be filled with one or more materials having properties of elasticity and damping. By way of example, in the central (16) and rear (17) recesses, use will be made of a material which will be described as "low-level damping material", i.e. having properties of elasticity with an intrinsic damping coefficient tg $\delta<0.4$, preferably tg $\delta$ between 0.1 and 0.4, measured using standard NF T 46 026 (at temperatures of −30° C. to +10° C. and at frequencies of 0.1 Hz to 120 Hz). This will allow a rebound, dynamic range and rapid transmission of impulses of the skier's foot. Elastomers such as natural rubbers, polychloroprenes, butyl rubbers or EPDM will be materials suited for such uses.

Additionally, by way of example, in the front recess (14) use will be made of a material which will be described as "viscoelastic" or "damping", i.e. having properties of elasticity with an intrinsic damping coefficient tg $\delta>0.4$, preferably tg $\delta$ between 0.8 and 1, measured using standard NF T 46 026 (at temperatures of −30° C. to +10° C. and at frequencies of 0.1 Hz to 120 Hz). This will allow damping of the vibrations originating from the ski and will give the skier a greater level of comfort. Elastomers such as chlorobutyls, nitrites or polyisoprenes will be suitable materials for such uses.

In another embodiment (not shown), the platform comprises two distinct rigid longitudinal parts. However, this platform has an asymmetry of structure between the two longitudinal parts. Use may be made of two different materials for each of the two longitudinal parts. Different stiffnesses will be envisaged, with a first longitudinal part produced by way of example from polyamide and a second longitudinal part produced from aluminium. Further, by way of example, one of the longitudinal parts with its recesses may have damping properties, whilst the other of the longitudinal parts with its recesses may have rebound properties.

In a sixth embodiment (cf. FIG. 9), each of the two longitudinal parts (9 and 11) of the platform (64) is itself divided transversely into two transverse pieces (18 and 19). Each of these transverse pieces (18 and 19) is separate from the other, with a certain distance between them.

The spaces located between the transverse pieces (18 and 19) are filled with one or more materials (21) having properties of elasticity and/or damping. This or these materials (21) make it possible physically to secure the transverse pieces (18 and 19) whilst allowing them freedom of movement.

In a seventh embodiment (cf. FIG. 10), the platform (65) comprises two distinct rigid longitudinal parts. However, this platform (65) has an asymmetry of the number of component pieces between the two longitudinal parts. The first longitudinal part (9) has the same dimensional and structural characteristics as the longitudinal parts (9 and 11) of the first embodiment. The second longitudinal part is itself divided into two transverse pieces (181 and 191). The two transverse pieces (181 and 191) of this second longitudinal part are preferably fitted on the side of the outside edge (31) of the ski (1).

Each of these transverse pieces (181 and 191) is separate from the other, with a certain distance between them. The spaces located between the transverse pieces (181 and 191) may be filled with one or more materials having properties of elasticity and/or damping. This or these materials make it possible physically to secure the transverse pieces (181 and 191) whilst allowing them freedom of movement. The outside edge will thus have less stiffness relative to the inside edge, the effects being substantially similar to those described above in the case of the second embodiment.

Figure 12:
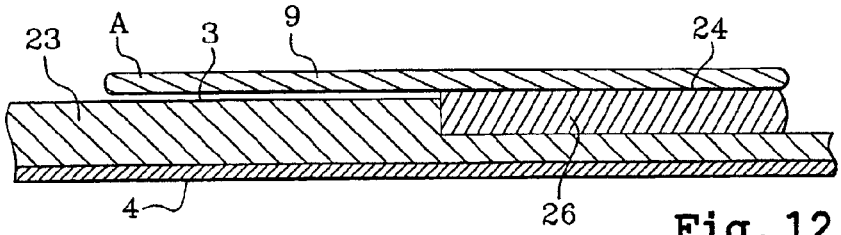
FIG. 12 shows a view in longitudinal section of the ski with its platform in the plane XII—XII in FIG. 11.
Figure 13:
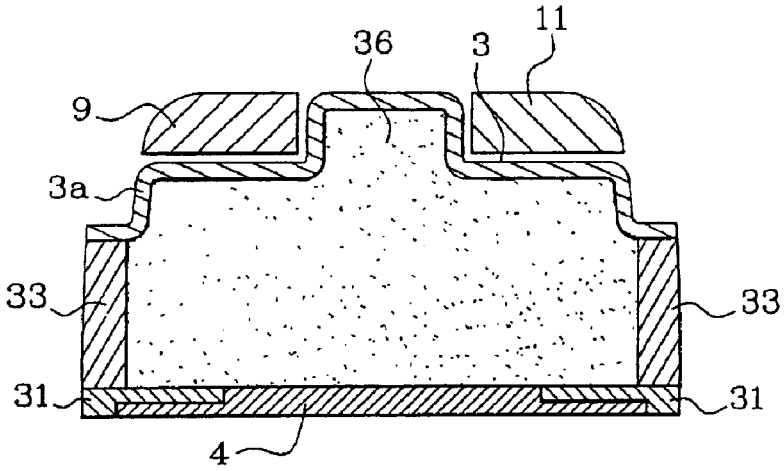
FIG. 13 shows a transverse-sectional view of a ski with its platform according to a ninth embodiment.

In an eighth embodiment (cf. FIGS. 11 and 12), the two longitudinal parts (9 and 11) are of the type described above in the first embodiment. The ski (22) on which they are fixed has a height discontinuity in the middle of its underfoot zone (23). Consequently, the ski (22) will have, in its front underfoot zone (23), a thickness which is greater than the thickness of the rear underfoot zone (24).

The two longitudinal parts (9 and 11) of the platform (66) may be fitted to the rear, overhanging, or they may rest at the rear on a thickness of material (26) having properties of elasticity. Use will preferably be made of a material (26) having properties of elasticity with an intrinsic damping coefficient tg $\delta<0.4$, preferably tg $\delta$ between 0.1 and 0.4, measured using standard NF T 46 026 (at temperatures of −30° C. to +10° C. and frequencies of 0.1 Hz to 120 Hz).

In the majority of cases, the two longitudinal parts (9 and 11) are separated from one another by a spacing (34). When this spacing (34) is left free, the upper surface (3) of the upper protective and decorative layer (3*a*) is visible, which creates interesting aesthetic effects. The spacing (34) may also be filled with one or more materials, in the form of an attached element, which is transparent or may optionally be coloured, and preferably a material with a low flexural strength.

In a ninth embodiment (cf. FIG. 13, in which a "Dualtec®"-type ski is more particularly shown), the spacing (34) is filled by a convex zone (36) of the ski. This convex zone (36) protrudes between the two longitudinal parts (9 and 11) relative to the upper surface (3) of the upper protective and decorative layer (3*a*). This makes it possible to prevent, for example, snow and ice becoming packed into the zone of the spacing (34) whilst preserving the mechanical separation of the two longitudinal parts (9 and 11).

Figure 14:
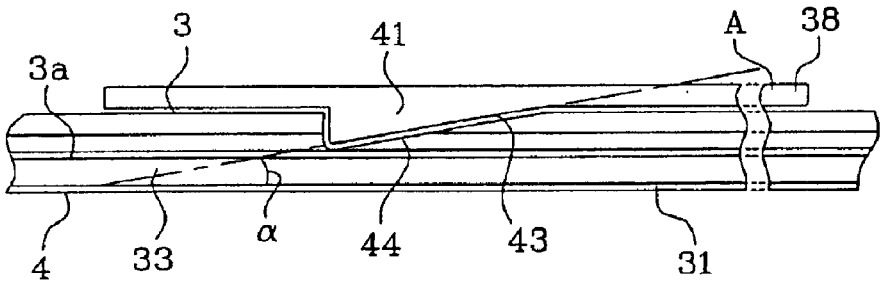
FIG. 14 shows a lateral view of a ski with its platform according to a tenth embodiment.

In a tenth embodiment (cf. FIG. 14), each of the two longitudinal parts (37 and 38) is extended laterally via a lateral portion or an appendix, respectively, (39 and 41). The two lateral portions (39 and 41) descend over each of the two lateral sides of the ski towards the edges (31). To allow this arrangement, the ski comprises, laterally, two hollowed zones, i.e. two lateral notches (44) located over the edges (33), having a similar shape that complements the two lateral portions (39 and 41) and which allow a positioning of these two lateral portions (39 and 41) of the two longitudinal parts (37 and 38). The two lateral portions (39 and 41) bear more directly via their edge or lower section (43) on the ski, over the lateral sides (33). The lower edge (43) is located only in a portion (41) of the lateral edge of the two longitudinal parts (38), being deployed downwards towards the edges (31).

It will be noted that the edges (43) of the two lateral portions (39 and 41) may be parallel to the gliding surface (4) of the ski. The edges (43) of the two lateral portions (39 and 41) may also not be parallel to the gliding surface (4) of the ski and, in such a case, a lower edge (43) of the two longitudinal parts (38) is not parallel to the surface of the gliding sole (4).

The lower edge (43) then has, in a longitudinal plane, a non-zero angle of inclination ($\alpha$) relative to the surface of the gliding sole (4) or relative to the upper surface (3) of the upper protective and decorative layer (3*a*) of the ski (1). This angle ($\alpha$) is between 1 and 20°, and preferably between 2 and 5°.

This lateral portion (29) is positioned substantially in the middle of the two longitudinal parts (28). This makes it possible to transfer the right and left impulses imparted by the skier directly towards the right and left edges (31) of the ski.

Figure 15:
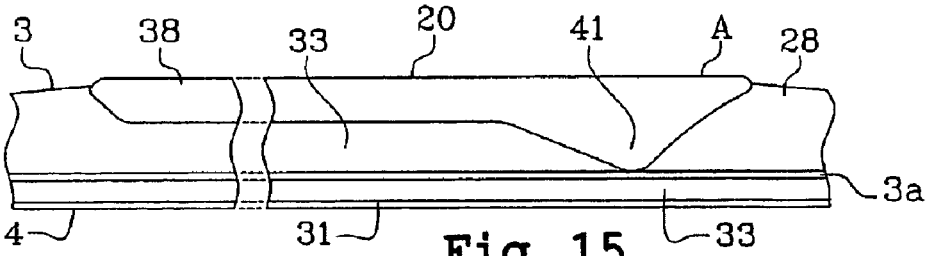
FIG. 15 shows a lateral view of a ski with its platform according to an eleventh embodiment.

In an eleventh embodiment (cf. FIG. 15), substantially with reference to the sixth embodiment described above, each of the two longitudinal parts (38) comprises a lateral portion (41). These two lateral portions (41) are more particularly positioned in the region of the zone of installation of the front stop of the binding for the boot on the ski of each of the two longitudinal parts (38). This makes it possible more efficiently to transfer the impulses towards the front part of the right and left edges (31) of the ski imparted by the skier when initiating a turn.

Figure 16:
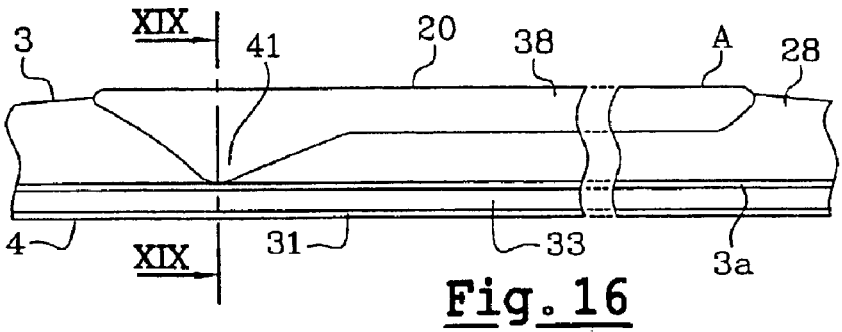
FIG. 16 shows a lateral view of a ski with its platform according to a twelfth embodiment.

In a twelfth embodiment (cf. FIGS. 16 and 19), substantially with reference to the sixth embodiment described above, each of the two longitudinal parts (38) comprises a lateral portion (41). These two lateral portions (41) are more particularly positioned in the region of the zone of installation of the rear heelpiece of the binding for the boot on the ski of each of the two longitudinal parts (38). This makes it possible more efficiently to transfer the impulses towards the rear part of the right and left edges (31) of the ski imparted by the skier when exiting a turn.

Figure 17:
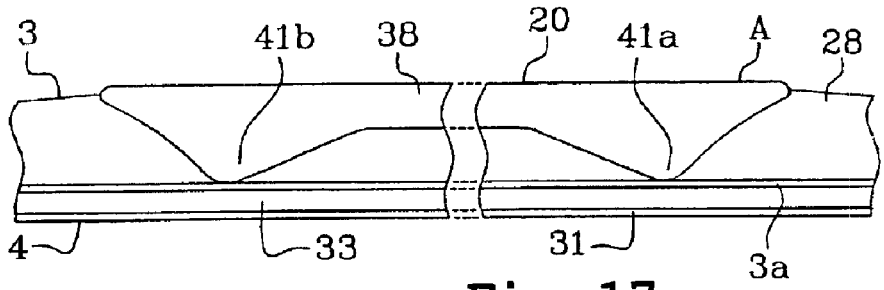
FIG. 17 shows a lateral view of a ski with its platform according to a thirteenth embodiment.

In a thirteenth embodiment (cf. FIG. 17), substantially with reference to the sixth embodiment described above, each of the two longitudinal parts (38) comprises two lateral portions (41*a* and 41*b*). These four lateral portions (41*a* and 41*b*) are more particularly positioned in the region of the zones of installation of the front stop and of the rear heelpiece of the bindings for the boot on the ski of each of the two longitudinal parts (38). This makes it possible more efficiently to transfer the impulses both towards the front and towards the rear of the right and left edges (31) imparted by the skier when initiating and exiting a turn.

In a fourteenth embodiment (cf. FIG. 18), substantially with reference to the ninth embodiment described above, each of the two longitudinal parts (38) comprises two lateral portions (41*a* and 41*b*) which are more particularly positioned in the region of the zones of installation of the front stop and rear heelpiece of the bindings for the boot on the ski of each of the two longitudinal parts (38).

Figure 18:
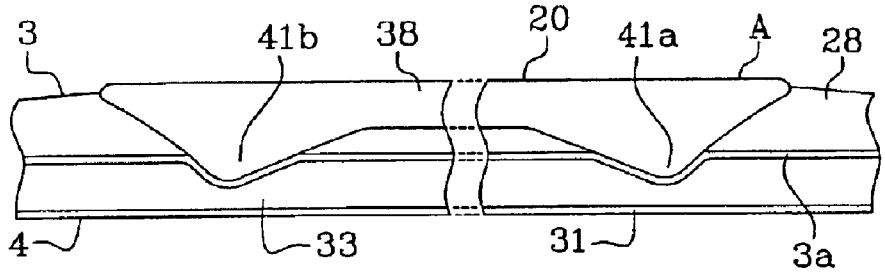
FIG. 18 shows a lateral view of a ski with its platform according to a fourteenth embodiment.

In FIGS. 14, 15, 16 and 17, the sides (33) have a constant height. In FIG. 18, sides (33) having a variable height have been shown, this height being smaller in the region of the lateral portions (41*a* and 41*b*) and greater in the centre, to the front and to the rear of the platform. The upper protective and decorative layer (3*a*) in this case matches the shape of the sides (33).

In all the embodiments (cf., however, more particularly, FIGS. 9, 15, 16, 17 and 18), the upper surface (3) of the ski (1) comprises two ribs (27 and 28) separated by a central hollow (29). The two ribs (27 and 28) are in the forward extension towards the tip and in the rearward extension of each of the two longitudinal parts (18, 19 and 38) of the platform.

In order to obtain a particularly interesting aesthetic effect (cf. more particularly FIGS. 15, 16, 17 and 18), the upper surface (3) of the ski is substantially flush with the rigid upper face (20) of the two longitudinal parts (37 and 38) of the platform.

Figure 19:
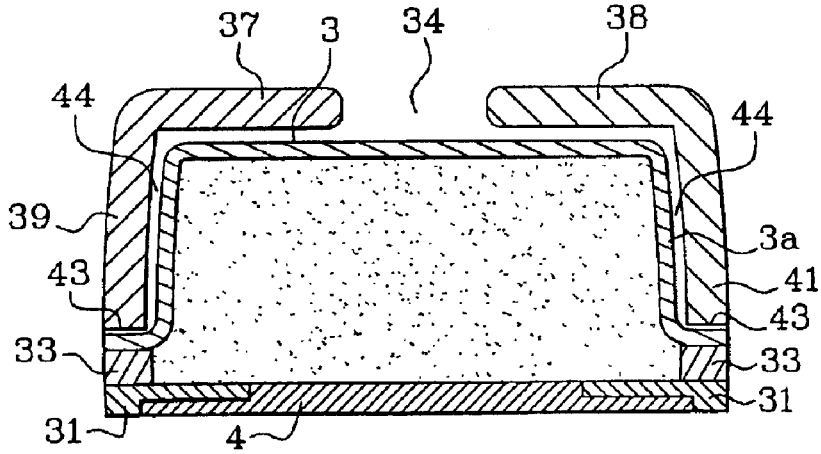
FIG. 19 shows a transverse-sectional view in the plane XIX—XIX in FIG. 16 of a ski with its platform according to the twelfth embodiment.

FIG. 19 also shows a "Dualtec®"-type ski, comprising two lateral partial sides (33), the upper surface (3) of the upper protective and decorative layer (3*a*) in this case forming a partial shell.

The present invention is not limited to the embodiments described and illustrated. A number of modifications may be made without thereby departing from the field defined by the scope of the set of claims.

The various embodiments described above may be combined with one another. Moreover, the platform may be fitted on all types of ski, "Dualtec®"-type skis, "rectangular-section" skis and "shell-structure" skis.

What is claimed is:

1. Raising platform for fitting on an upper surface (3) of a board for gliding over snow in order to receive and to raise bindings (7, 8) securing a user's boot to the board (1) for gliding over snow, wherein the platform is divided into two longitudinal parts (9, 11) along the central longitudinal axis of the board (1).

2. Platform according to claim 1, wherein at least one of the two longitudinal parts (9, 11) comprises at least one recess (14, 16, 17) located in the region of its face of contact with the upper surface (3) of the board for gliding over snow.

3. Platform according to claim 2, wherein the recess or recesses (14, 16, 17) are filled with one or more materials which have properties of elasticity and damping.

4. Platform according to claim 1, wherein a spacing (34) is provided between the two longitudinal parts (9, 11) which are separated from one another.

5. Platform according to claim 4, wherein the spacing (34) is filled by a convex zone (36) of the board for gliding over snow which projects relative to the upper surface (3) of an upper protective and decorative layer (3*a*) of the board for gliding over snow or is filled by one or more materials with low flexural strength.

6. Platform according to claim 1, wherein at least one of the two longitudinal parts (9, 11) of the platform (64) is itself divided transversely into at least two transverse pieces (18, 19).

7. Platform according to claim 6, wherein the space or spaces located between at least one of the transverse pieces (18, 19) which are separated from one another are filled with one or more materials (21) which have properties of elasticity and damping.

8. Platform according to claim 1, wherein the platform is secured to a board for gliding over snow having a thickness in the region of the front portion (23) of the zone for fitting the platform greater than the thickness in the region of the rear portion (24) of the zone for fitting the platform.

9. Platform according to claim 1, wherein at least one of the two longitudinal parts (9, 11) comprises two anchoring zones (12, 13), at least a first anchoring zone (12) allowing a fixed positioning relative to the board for gliding over snow and at least a second anchoring zone (13) allowing a positioning with sliding relative to the board for gliding over snow.

10. Platform according to claim 1, wherein at least one of the two longitudinal parts has a tubular structure over a part of or over all its length and over a part of or over all its width.

11. Platform according to claim 1, wherein at least one of the two longitudinal parts (37, 38) extends laterally via at least one lateral portion (39, 41) descending over each of the two lateral sides towards the edges (31) of the board for gliding over snow.

12. Platform according to claim 11, wherein the lower edge (43) of the lateral portion or portions (41) of at least one of the two longitudinal parts (38) has, in a longitudinal plane, a non-zero angle of inclination ($\alpha$) relative to the gliding sole (4) of the board for gliding over snow.

13. Platform according to claim 11, wherein at least one of the two longitudinal parts (37, 38) extends laterally via a lateral portion (39, 41) positioned in the region of the zone for installation of the front stop of the binding for the boot on the ski.

14. Platform according to claim 11, wherein at least one of the two longitudinal parts (37, 38) extends laterally via a lateral portion (39, 41) positioned in the region of the zone for installation of the rear heelpiece of the binding for the boot on the ski.

15. Platform according to claim 11 wherein at least one of the two longitudinal parts (37, 38) extends laterally via a lateral portion (41*a*) positioned in the region of the zone for installation of the front stop of the binding for the boot on the ski and via a lateral portion (41*b*) positioned in the region of the zone for installation of the rear heelpiece of the binding for the boot on the ski.

16. Platform according to claim 1, wherein the platform has an asymmetry between the two longitudinal parts.

17. Platform according to claim 16, wherein the platform has an asymmetry of length between the two longitudinal parts (9, 111) and/or an asymmetry of width between the two longitudinal parts (92, 112) and/or an asymmetry of the means for fitting between the two longitudinal parts (9, 113) and/or an asymmetry in the number of transverse pieces between the two longitudinal parts (9, 181, 191) and/or an asymmetry of structure and of materials between the two longitudinal parts.

18. Board for gliding over snow, wherein the board is equipped with a platform (6) according to claim 1.

19. Board for gliding over snow according to claim 18, wherein the board has, on at least one of the two sides, a lateral notch (32, 44) located over the sides (33) and allowing a positioning of the respective lateral portion (39, 41) of at least one of the two longitudinal parts (37, 38) of the platform.

20. Board for gliding over snow according to claim 18, wherein the board has, on at least one of the two sides, two lateral notches (44) located over the sides (33) and allowing a positioning of the two respective lateral portions (39, 41) of at least one of the two longitudinal parts (37, 38) of the platform.

21. Board for gliding over snow according to claim 18, wherein its upper surface (3) is substantially flush with the rigid upper face (20) of at least one of the two longitudinal parts (37, 38) of the platform.

22. Board for gliding over snow according to claim 18, wherein its upper surface (3) comprises one or two ribs (27, 28) which are separated by a central hollow (29), the one or two ribs (27, 28) being in the extension towards the front and/or towards the rear of the one or two longitudinal parts (18, 19) of the platform.

23. Board for gliding over snow according to claim 18, wherein the board comprises a height discontinuity between the front portion (23) of the zone for fitting the platform and the rear portion (24) of the zone for fitting the platform such that the thickness of the board for gliding over snow in the front portion (23) of the zone for fitting the platform is greater than the thickness of the board for gliding over snow in the rear portion (23) of the zone for fitting the platform.

* * * * *